United States Patent [19]

Zupančič et al.

[11] 4,191,478

[45] Mar. 4, 1980

[54] MIXING APPARATUS FOR CONCRETE OR OTHER BULK MATERIAL

[76] Inventors: Viktor Zupančič; Franc Zupančič; Tomaz Zupančič, all of Cesta v gorice 10/D, 61000 Ljubljana, Yugoslavia

[21] Appl. No.: 875,881

[22] Filed: Feb. 7, 1978

[30] Foreign Application Priority Data

Feb. 7, 1977 [YU] Yugoslavia ..... 314/77

[51] Int. Cl.[2] ..... B28C 7/02; B28C 7/14

[52] U.S. Cl. ..... 366/39; 366/65; 366/67

[58] Field of Search ..... 366/65, 66, 67, 30, 366/31, 32, 33, 34, 36, 37, 39, 40, 41, 177, 181, 183, 311, 312, 314, 325

[56] References Cited

U.S. PATENT DOCUMENTS

| | | | |
|---|---|---|---|
| 2,717,147 | 9/1955 | Fejmert | 366/65 |
| 3,081,983 | 3/1963 | Thibodeaux | 366/65 |
| 3,228,664 | 1/1966 | McMillan | 366/65 |
| 3,506,246 | 4/1970 | Mordhorst | 366/39 |
| 3,536,304 | 10/1970 | Fejmert | 366/65 |

FOREIGN PATENT DOCUMENTS

| | | |
|---|---|---|
| 824012 | 10/1951 | Fed. Rep. of Germany . |
| 933397 | 12/1947 | France . |
| 1222527 | 12/1960 | France . |
| 1487367 | 5/1967 | France . |

OTHER PUBLICATIONS

Pages 565 and 566 of Russian Handbook entitled "Construction Machines" by Bauman.

*Primary Examiner*—Robert W. Jenkins
*Attorney, Agent, or Firm*—Karl F. Ross

[57] ABSTRACT

A mixing apparatus, e.g. for making concrete, has a triangular base supporting a rotatable or nonrotatable, upwardly open cylindrical drum as well as a main shaft carrying a large sprocket wheel which is linked by a chain with a smaller sprocket wheel on an auxiliary shaft journaled on one of the sides of the triangle. A motor mounted on another side of the base drives the auxiliary shaft via a speed-reducing belt transmission. The main shaft and/or an extension thereof above the drum carries ancillary force-transmitting members such as a reel or a sprocket for the selective operation of external accessories, e.g. a shovel, a hoist, or a force pump. Bulk material in the drum is agitated by a set of relatively rotating blades which may be driven by the main shaft or by a separate motor.

19 Claims, 36 Drawing Figures

94
K
90
92
88
300
86
101
39
84
39
100
102
82
95'
9
79
G
77
78
103
C1
8
90
95
13
11
71
74
72
75
66
73
C
76
73'
64
68
70
62
60
182
C1
58
59
61
69
58
19
306
65
67
109
12
63
111
109
6'
H
108
107
107
307
10
96
E
C2
80
98
99
83
81
97
85
168''
87
89
91
K
93

104
105
106

Fig. 26
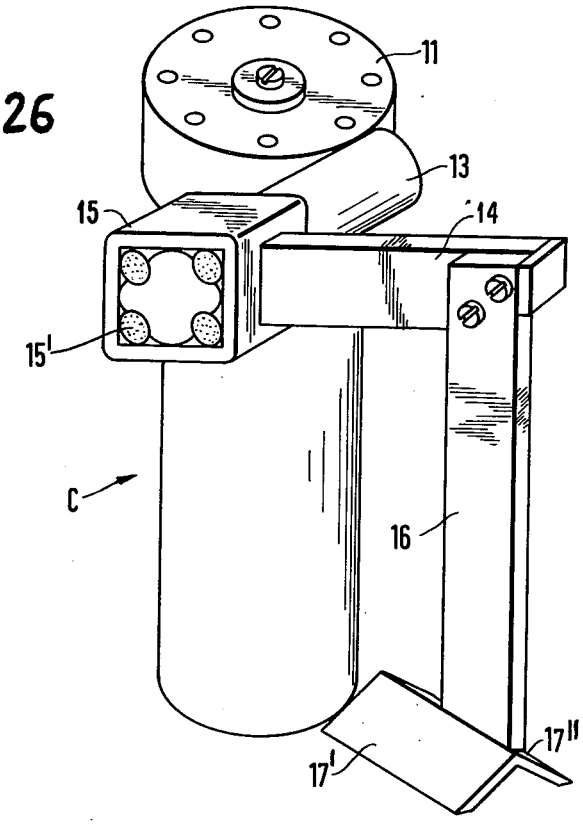
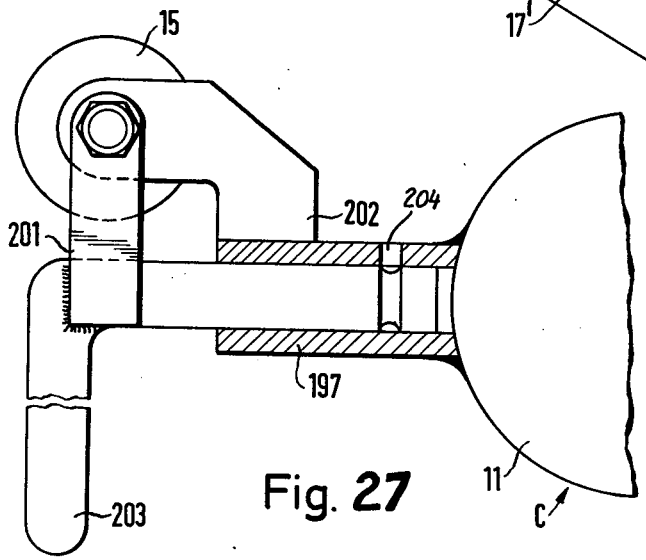
Fig. 27

MIXING APPARATUS FOR CONCRETE OR OTHER BULK MATERIAL

FIELD OF THE INVENTION

Our present invention relates to an apparatus for the mixing of concrete or other types of bulk material by automatic means.

BACKGROUND OF THE INVENTION

Conventional mixers are specialized for their particular purposes and difficult to adapt to other uses. Also, they often require excessive power when their material-handling capacity is not fully utilized.

OBJECT OF THE INVENTION

Thus, the object of our present invention is to provide an improved mixing apparatus of great versatility, compact construction and economical mode of operation.

SUMMARY OF THE INVENTION

An apparatus according to our invention comprises, essentially, a framework including a generally triangular base on which there is supported an upwardly open mixing drum centered on a substantially vertical axis. The drum is provided with agitator means, such as a set of blades, mounted for rotation relative to the drum as is well known per se. For bringing about such relative rotation, as well as for performing related tasks such as supplying the drum with sand from a nearby pit, we provide drive means including a motor which is secured to the framework on one side of the triangular base, an auxiliary shaft journaled on another side of the base, a first step-down transmission such as a belt drive linking the motor with the auxiliary shaft, and a second step-down transmission such as a chain drive linking the auxiliary shaft with a main shaft centered on the drum axis, this main shaft carrying at least one ancillary force-transmitting member, e.g. a sprocket wheel or a cable-winding reel, forming part of a power train which is selectively actuatable for the control of associated material-handling equipment such as a shovel and/or a hoist.

If the drum is stationary, the main shaft having a lower portion engaged by the chain drive may extend through the drum and support an array of spider arms on an upper shaft portion forming a hub elevated above the drum bottom, the agitator means being secured to these arms preferably through the intermediary of elastic joints. The upper shaft portion carrying the agitator means could also be driven by a separate motor.

The base may be supported at its vertices by three wheels or, alternatively, by stationary columns.

BRIEF DESCRIPTION OF THE DRAWING

The above and other features of our invention will now be described in detail with reference to the accompanying drawing in which:

FIG. 26 is an axonometric view, again on an enlarged scale, of an elastic joint supporting an agitator blade;

FIG. 27 is a plan view, partly in section, of a modified blade support;

SPECIFIC DESCRIPTION

The principal components of an apparatus according to our invention are generally identified as follows:

A: supporting framework with associated drive means;

B: mixer drum;

C: main shaft assembly with associated brake and clutch means;

D: agitator assembly;

E: shovel drive;

F: separate loading equipment;

G: hoist drive;

H: transporter for bulk material;

I: plastering machine;

J: separate agitator drive;

K: manual and automatic actuators;

L: comminuting equipment

M: electro-hydraulic control system; and

N: electromechanical control system.

SPECIFIC DESCRIPTION

Figures 1, 3, 4:
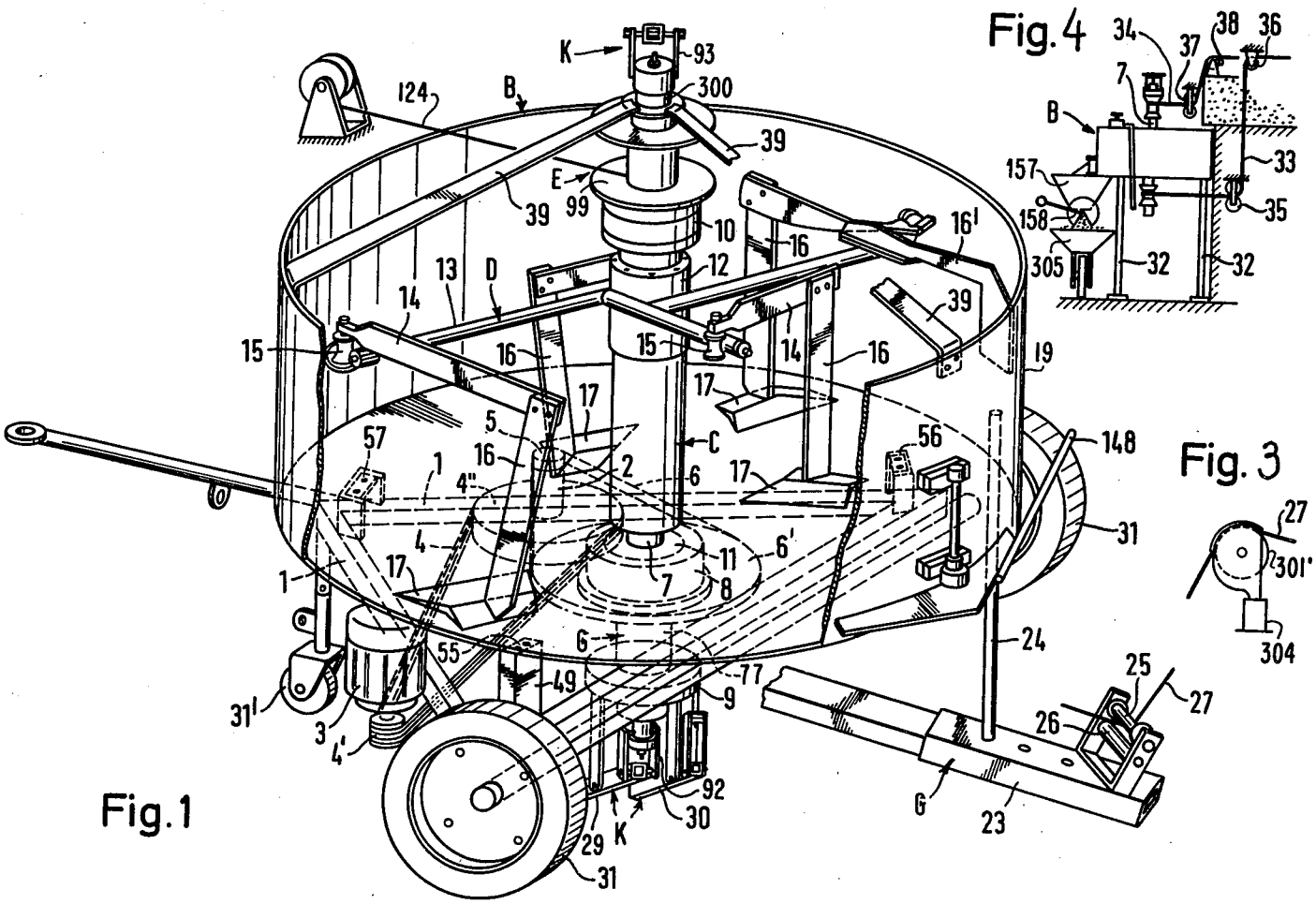
FIG. 1 is an axonometric view of a mixer according to our invention, with parts broken away.
FIG. 3 is a detail view of a pulley forming part of the crane of FIG. 2.
FIG. 4 is an elevational view of an apparatus according to our invention, drawn to a reduced scale.
Figure 8:
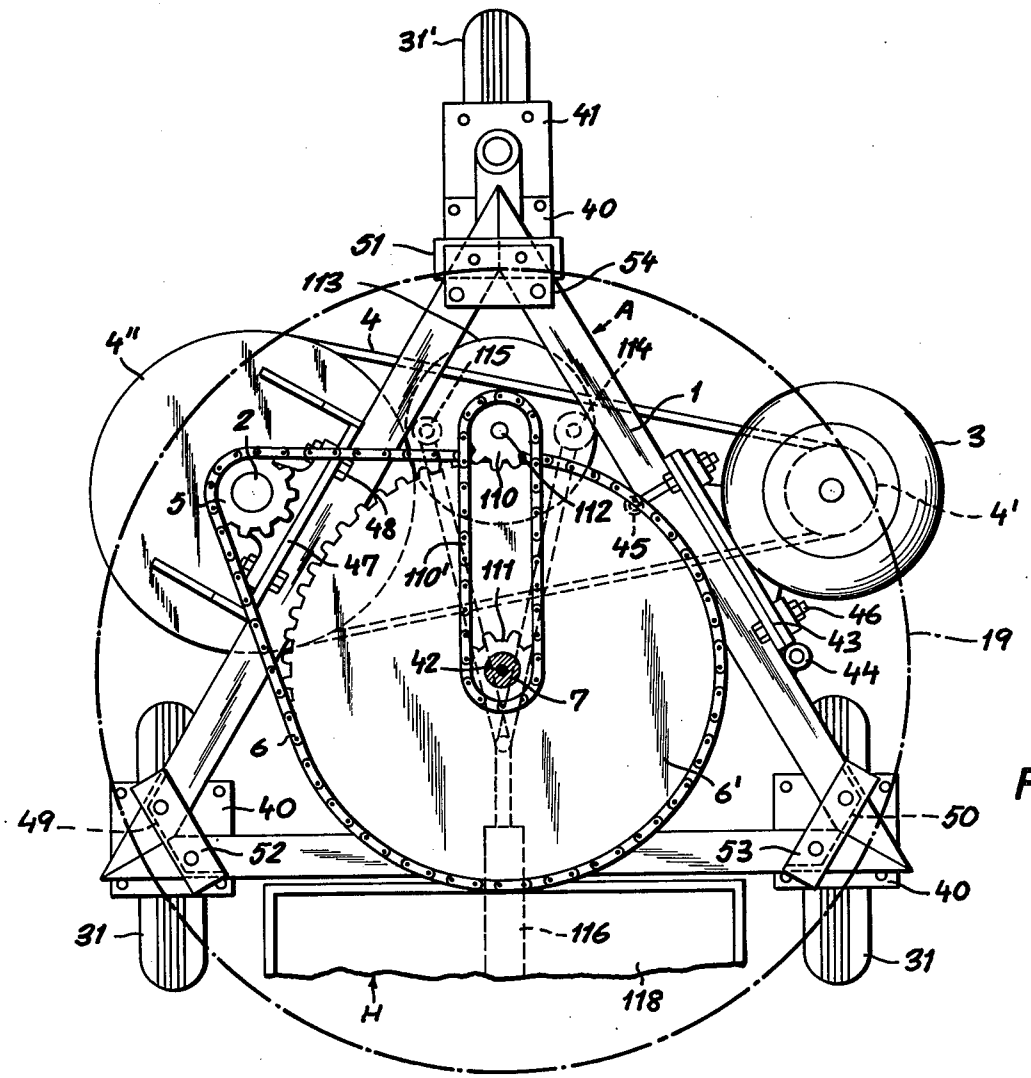
FIG. 8 is a plan view of an undercarriage serving as a supporting framework for the mixer of FIG. 1.
Figure 9:
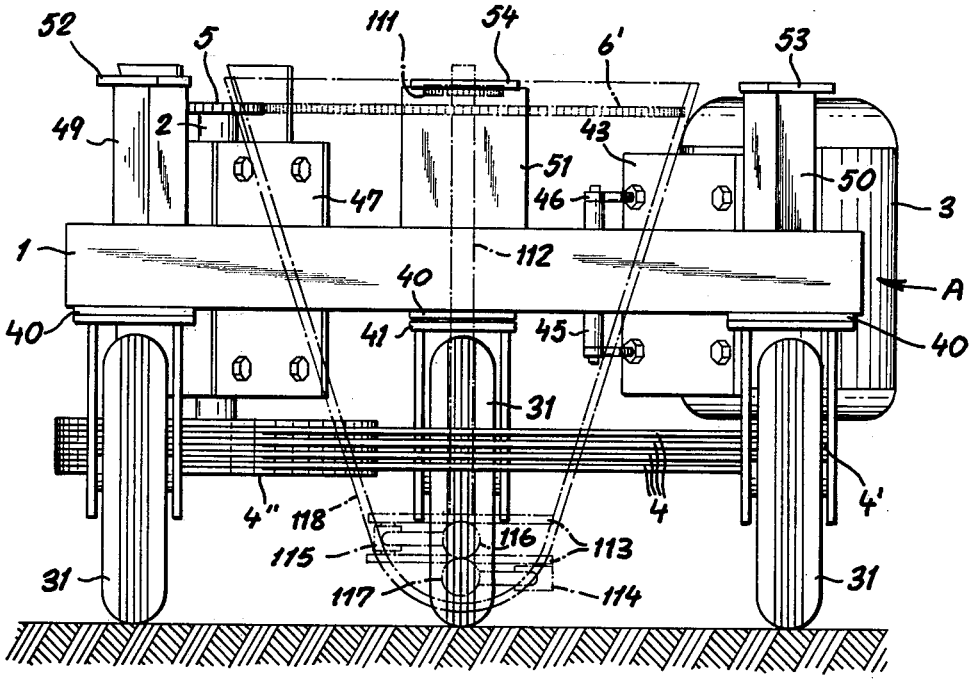
FIG. 9 is a side-elevational view of the undercarriage of FIG. 8.

In FIG. 1 we have shown a mixer drum B in the form of an upwardly open cylinder 19 which is supported on a triangular base 1 forming part of a framework A (see FIGS. 8 and 9). Centered on the drum axis 42 (FIG. 8) is a shaft assembly C driven by a motor 3 via a small pulley 4' on the motor shaft, a belt 4, a large pulley 4'' on an auxiliary shaft 2 also carrying a small sprocket wheel 5, and a large sprocket wheel 6' on shaft assembly C linked with sprocket wheel 5 by a chain 6. The two transmissions 4, 4', 4'' and 5, 6, 6' are best seen in FIG. 8; that Figure also shows brackets 43, 47 by which motor 3 and shaft 2 are respectively mounted on different sides of the triangular base 1. Bracket 47 is secured to the base by bolts 48 whereas bracket 43 is swingable about a pivot 44 and is adjustably engaged by a bolt 46 pivoted to the base at 45.

Figure 7:
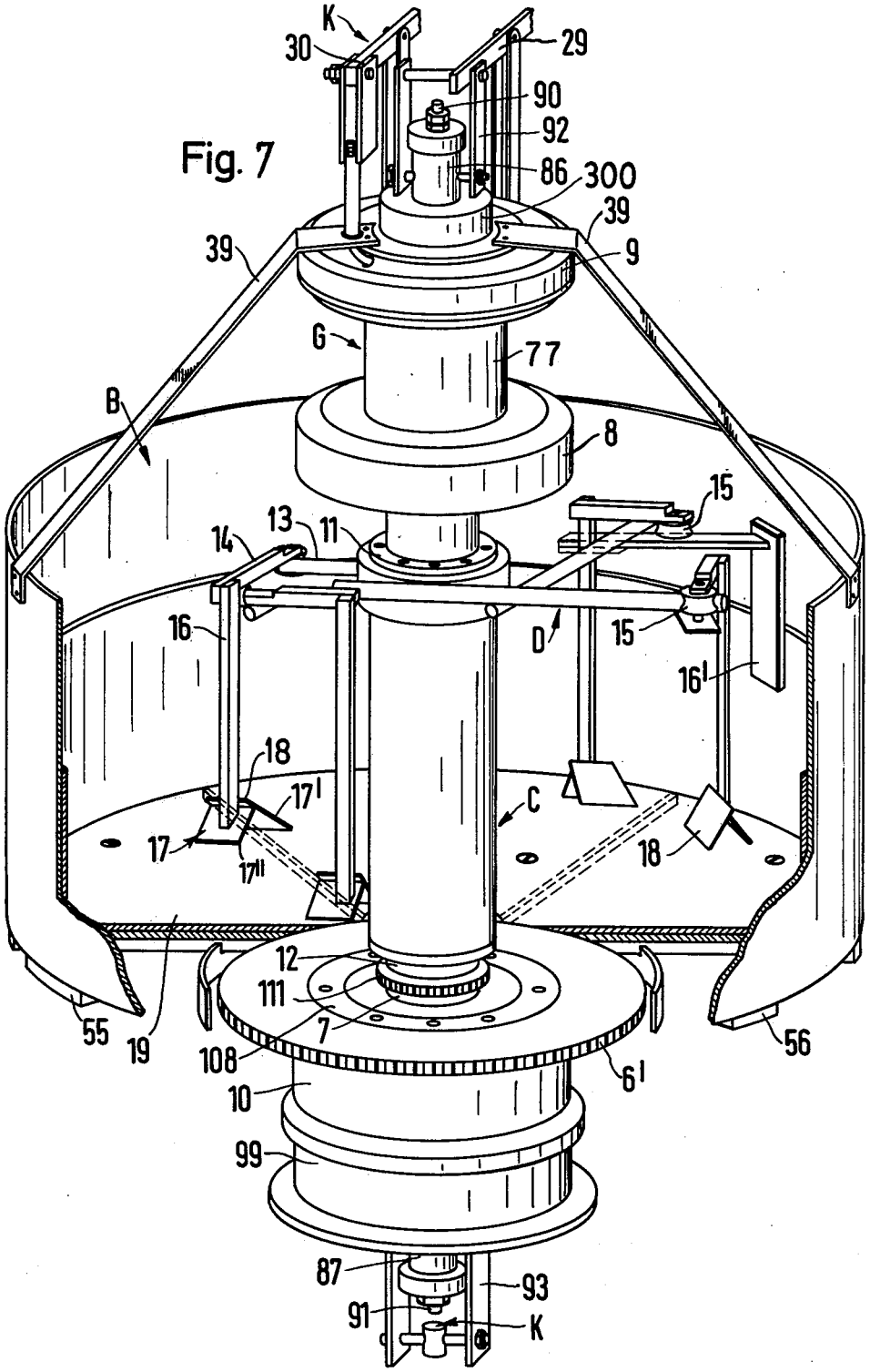
FIG. 7 is an axonometric view similar to FIG. 1 but drawn to a larger scale, showing details of a modified mixer according to our invention.
Figure 30:
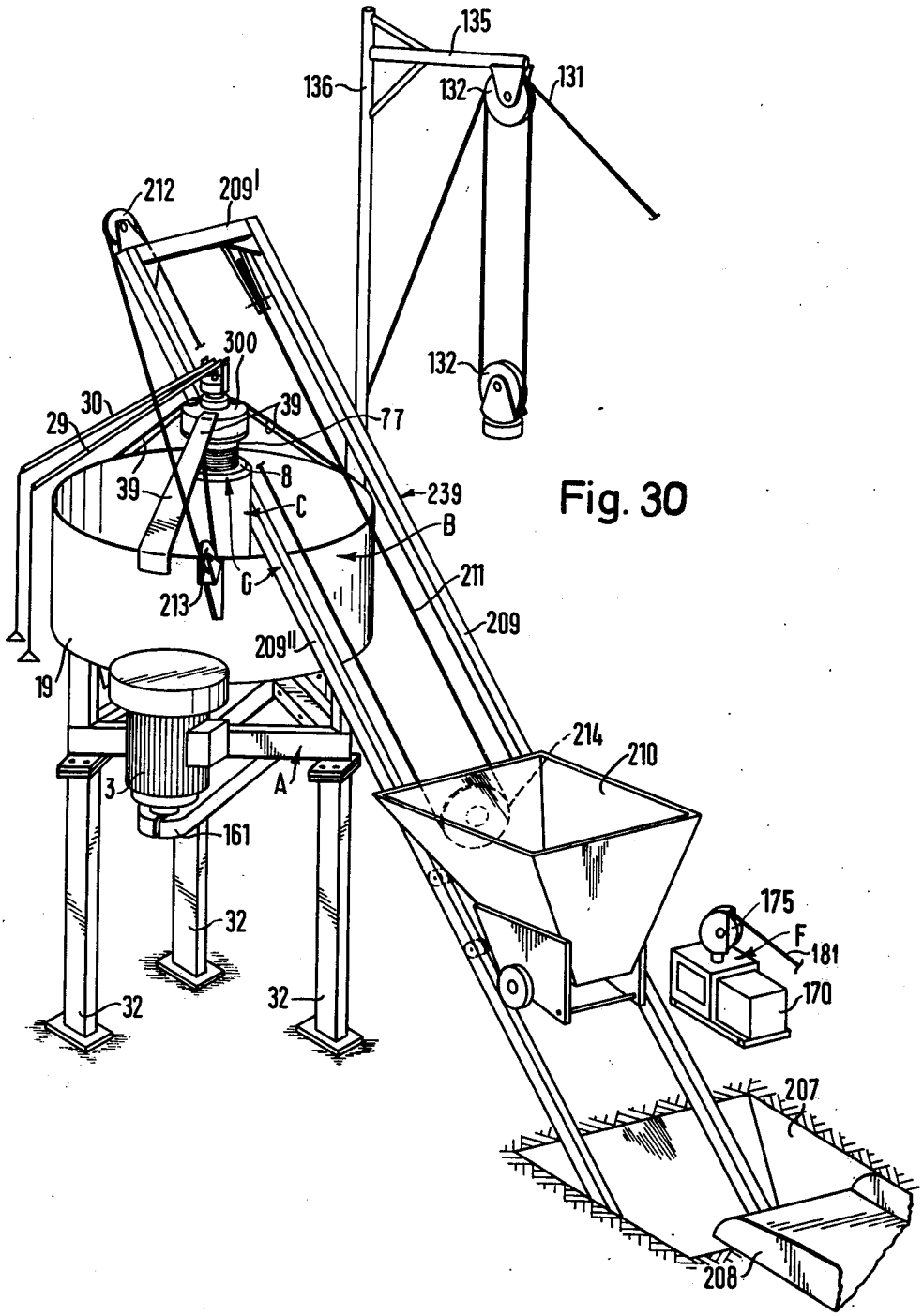
FIG. 30 is an axonometric view of yet another apparatus including a mixer according to our invention.

Assembly C comprises a main shaft 7 carrying clutches 8, 9 and 10 as well as hubs 11 and 12. Clutches 8–10, as seen in FIG. 11, resemble drum-type automotive brakes and are controlled by cables 90, 91, 94 forming part of an actuating mechanism K; this mechanism includes draw levers 92 and 93 which may be actuated manually or electromagnetically, e.g. via handles 29 and 30 as shown in FIGS. 1, 7 and 30.

Figures 11, 12:
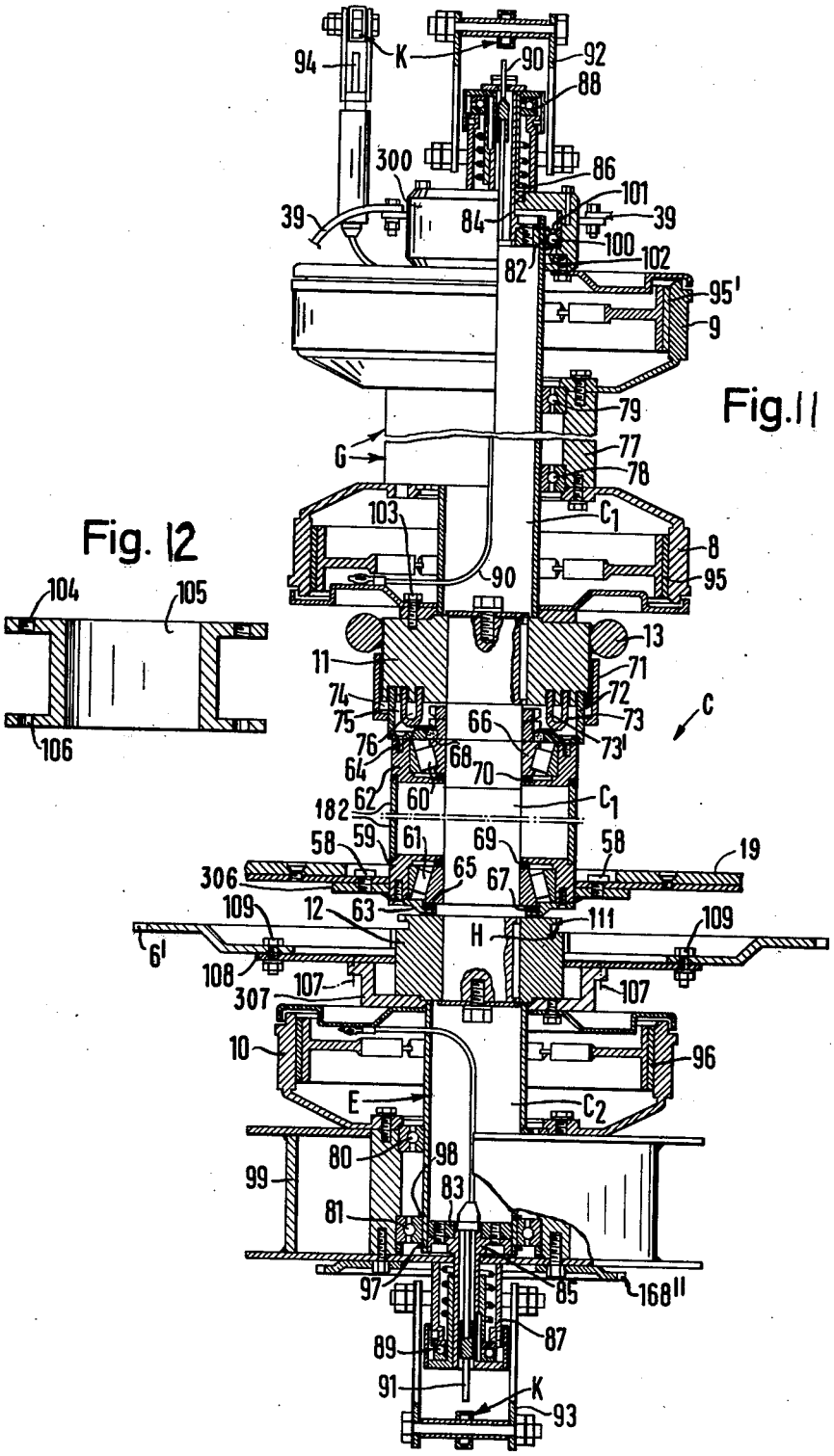
FIG. 11 is an elevational view, partly in section, of a main shaft of a mixer according to our invention.
FIG. 12 is a sectional elevational view of an insert to be used with the shaft of FIG. 11.

It should be noted at this point that the extremities of shaft assembly C shown in FIG. 11 are substantially symmetrical so that this assembly can be used either in the position of FIG. 11 (see also FIG. 7) or in an inverted position as in FIG. 1. Thus, FIG. 11 shows an upper shaft portion $C_1$ above drum 19 and a lower shaft portion $C_2$ beneath it, this lower portion carrying the sprocket 6', the hub 12 and the clutch 10 secured to a wind-up reel 99; clutch 10 and reel 99 form part of a shovel drive E whereas clutches 8 and 9 on the upper shaft portion $C_1$ form part of a hoist drive G. In FIG. 1 the hoist drive G is below the drum whereas the reel 99 of shovel drive E lies near the top of the shaft assembly and is shown connected with a cable 124 whose function will be described hereinafter.

Figure 28:
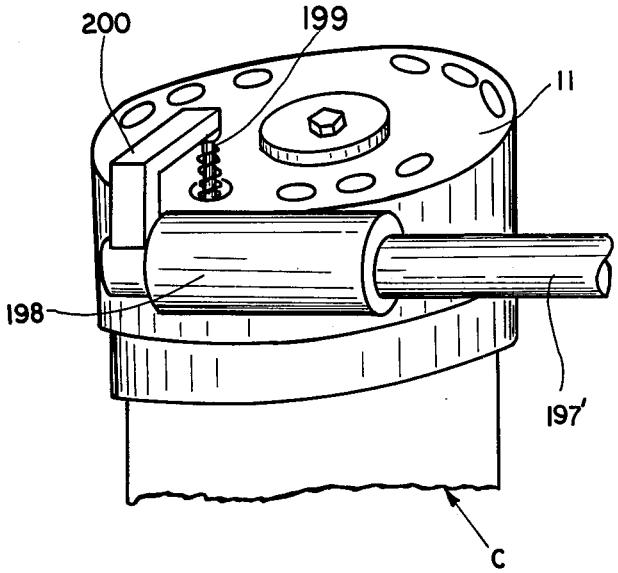
FIG. 28 is a fragmentary axonometric view of another blade-supporting joint.

The upper hub (12 in FIG. 1) supports a spider, forming part of an agitator D, whose arms 13 extend tangentially outwardly from that hub and are connected by way of preferably elastic joints 15 with transverse bars 14 to which legs 16 are attached, these legs terminating in stirring blades 17 which rest on the bottom of drum body 19. As shown in FIG. 7, each blade 17 is generally gable-shaped with oppositely inclined sections 17' and 17'', section 17' being overlain by a pad 18. Each joint 15 may be designed as a prismatic sleeve, FIG. 26, surrounding a generally rhomboidal extremity of the associated spider arm 13 with interposition of rubber inserts 15'. Another construction, shown in FIG. 27, comprises a tubular boss 197 rigid with the supporting hub (here 11) into which a blade-carrying arm 203 is inserted, its dislodgment being prevented by a plug 204; arm 203 is held against rotation by a lug 201 secured to a bracket 202 on boss 197. A different, more complex joint is illustrated in FIG. 28 where a sleeve 198 is secured to the hub 11 and forms a bearing for a rod 197' having a bracket 200 connected with the hub through a spring 199.

Figure 5:
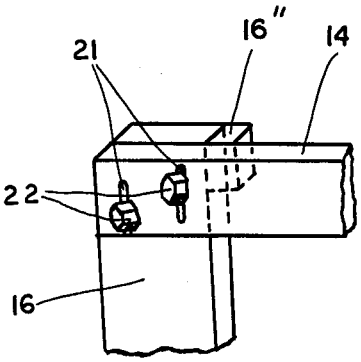
FIGS. 5 and 6 are perspective detail views of joints forming part of a blade support in the mixer of FIG. 1.
Figure 6:
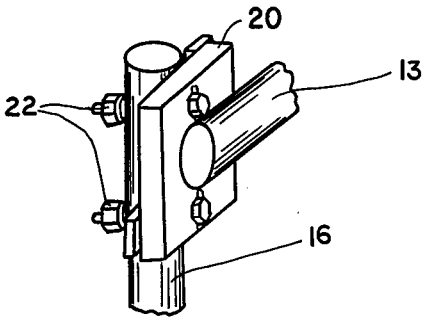

As shown in FIG. 5, bars 14 may be rigidly connected with legs 16 by means of screws 22 passing through slots 21 of the bar, with the addition of a reinforcing block 16''. FIG. 6 shows the legs 16 attached to a spider arm 13 by screws 22 with interposition of a block 20, bar 14 being omitted.

Also illustrated in FIGS. 1 and 7 is a wiper blade 16' which is mounted on one of the spider arms 13 and moves along the inner periphery of the drum, at about two-thirds of its axial height.

The upper end of the main shaft is journaled in a bearing ring 300 supported on the rim of the drum by stays 39.

Figure 2:
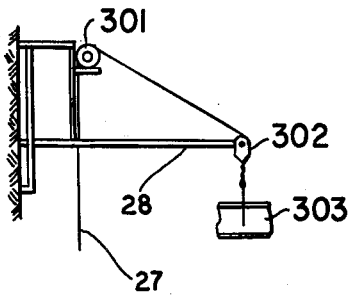
FIG. 2 is an elevational view of a portion of a building crane associated with the mixer of FIG. 1.

A bar 23 supported by a rod 24 carries a pair of guide rollers 25, 26 engaging a cable 27 which, as shown in FIG. 2, passes around a deflecting roller 301 and another guide 302 on a boom 28 of a building crane to lift a load 303. A modified deflecting roller 301', shown in FIG. 3, has a swivel mounting 304. Cable 27 can be wound on a reel 77, below drum 1, which is coupled with clutch 9 and like bar 23 forms part of hoist drive G.

Figure 19:
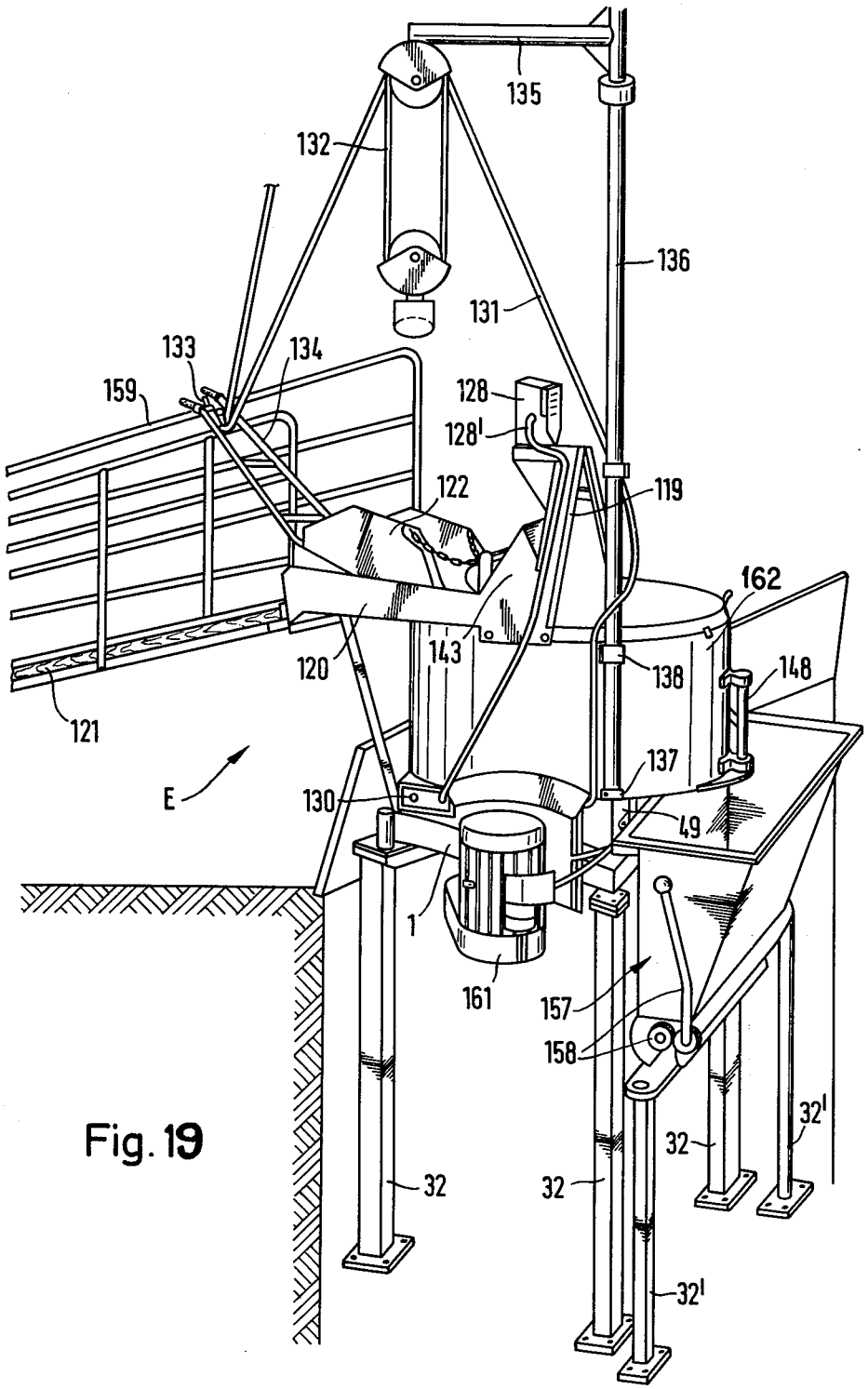
FIG. 19 is a view similar to FIG. 18, illustrating a further modification.

In FIGS. 1, 8 and 9 we have shown the base 1 supported by two rear wheels 31 and one front wheel 31' provided with respective mounting plates 40 as well as a fork 41 in the case of wheel 31'. Plates 40 can also be used to support the base on fixed columns 32, as illustrated in FIGS. 4 and 19; these two Figures further show an unloader 157, resting on columns 32', which receives the mixture from drum B and discharges it into a vessel 305 through a bottom gate 158.

FIG. 4 further illustrates, schematically, a pair of reels on shaft 7 for the wind-up of respective cables 33 and 34 guided around rollers 35 and 36–38, respectively. Cables 33 and 34 may respectively form part of a hoist drive and a shovel drive similar to those shown at G and E in FIG. 1.

The connection between the drum B and the underlying framework A is established by columns 49, 50, 51 (FIGS. 8 and 9) which rise from plates 40 and are welded to perforated plates 52, 53, 54 that are bolted to respective brackets 55, 56, 57 on the underside of the drum.

As shown in FIG. 11, a ring 59 has a flange 306 fastened to the bottom of drum body 19 with bolts 58. Ring 59 and a similar ring 62, interconnected by a sleeve 182, form outer races for respective bearings 60 and 61 whose inner races are shoulders 65 and 66 of shaft portion $C_1$ which are bracketed by inward extensions of rings 59, 62 as well as flanges 63, 64 respectively bolted to these rings, with interposition of felt inserts 67–70.

The space above bearing 60 is subdivided into several annular compartments 74, 75 and 76, filled with lubricating grease, by a sleeve 71 on ring 62 and labyrinth-type lips 72, 73, 73' on hub 11. Clutch 8 is shown directly fastened to hub 11 by bolts 103, yet an annular spacer 105 shown in FIG. 12 could be interposed, if necessary. This spacer has upper and lower flanges with respective bores 104 and 106 designed to receive connecting bolts 103, the upper bores 104 being shown threaded for this purpose.

Wind-up reel 77 of hoist drive G, flanked by clutches 8 and 9, is shown supported by bearings 78 and 79 on shaft portion $C_1$. Similar bearings 80 and 81 support the reel 99 of shovel drive E adjacent clutch 10 with whose cylindrical part that reel is positively connected. Bearing 81 is held in place by circlips 97 and 98 designed to maintain the reel 99 and the clutch cylinder in the proper axial position with reference to the end disk of the clutch which is rigidly connected with hub 12 and sprocket 6' by a collar 307, screws 107, a flange 108 and bolts 109. Similar circlips 101 and 102 maintain the relative axial position between the shaft assembly C and the stationary ring 300 in which this assembly is journaled by a bearing 100.

The actuating mechanism K is shown to comprise casings 85 and 86 articulated to the nonrotating draw levers 92 and 93, these casings being provided with thrust bearings 88 and 89 engaged by spring-loaded plungers 84 and 85 respectively surrounding the cables 90 and 91 which rotate with the end disks of their respective clutches that are fixedly secured to shaft C. The several clutches 8–10 could also be operated hydraulically, with the aid of respective brake shoes 95, 95' and 96; in this case the cables 90 and 91 would be replaced by suitable tubing.

Also shown in FIG. 11 are two sprockets 111, integral with hub 12, and 168'', fastened to reel 99. Sprocket 111 forms part of a transporter H, more fully described hereinafter with reference to FIGS. 8–10, whereas sprocket 168'' can be used to drive a plastering machine I to be described with reference to FIG. 21.

Although clutch 8 is structurally similar to clutches 9 and 10, its end disk is shown fastened to the stationary structure 39, 300 so that it operates as a brake when actuated by a nonrotating part of mechanism K including the control cable 94.

Figure 10:
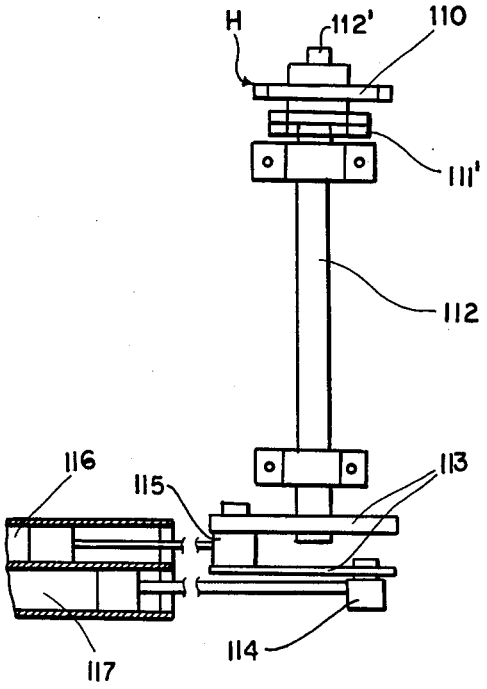
FIG. 10 is a fragmentary view of a force pump included in the assembly of FIGS. 8 and 9.

As shown in FIGS. 8 and 9, the aforementioned transporter H (shown in phantom lines in FIG. 9) includes a tank 118 equipped with a force pump which comprises a pair of cylinders 116, 117 having pistons articulated at 115 and 114 to a crank 113 on a vertical shaft 112; see also FIG. 10. Shaft 112 has an extension 112', coupled to it by a clutch 111', which carries a sprocket 110 linked by a chain 110' with the sprocket 111 which is integral with hub 12 (FIG. 11) and overlies the sprocket 6', the position of the two sprockets 6' and 111 being indicated in phantom lines in FIG. 9. Thus, when the assembly H is juxtaposed with the drum B as shown in FIG. 8, actuation of clutch 111' causes the pump 116, 117 to be driven for discharging the prepared mixture from the tank 118. Drum B has been indicated in phantom outline in FIG. 8.

Figure 13:
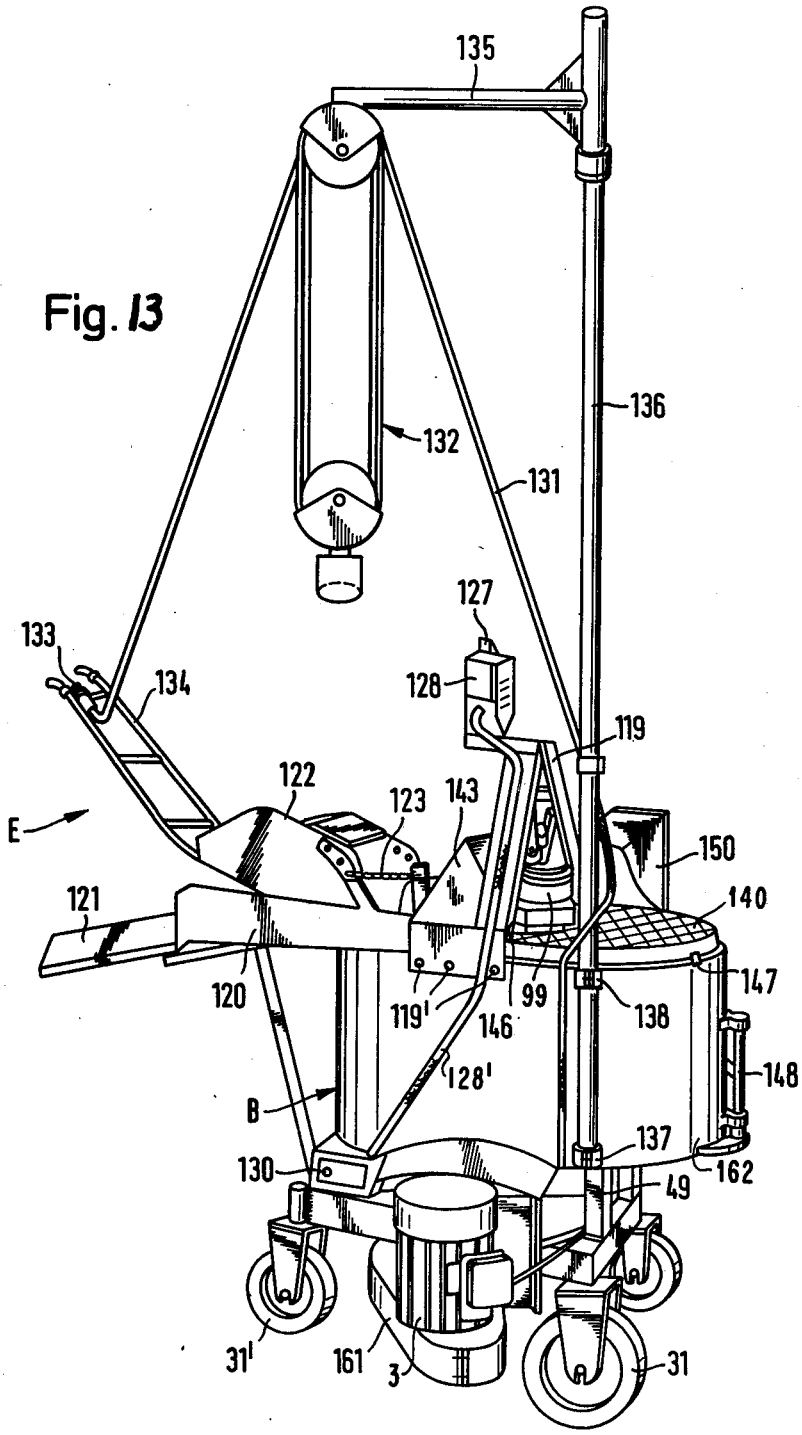
FIG. 13 is an axonometric view of an apparatus according to our invention comprising another modified mixer.
Figure 20:
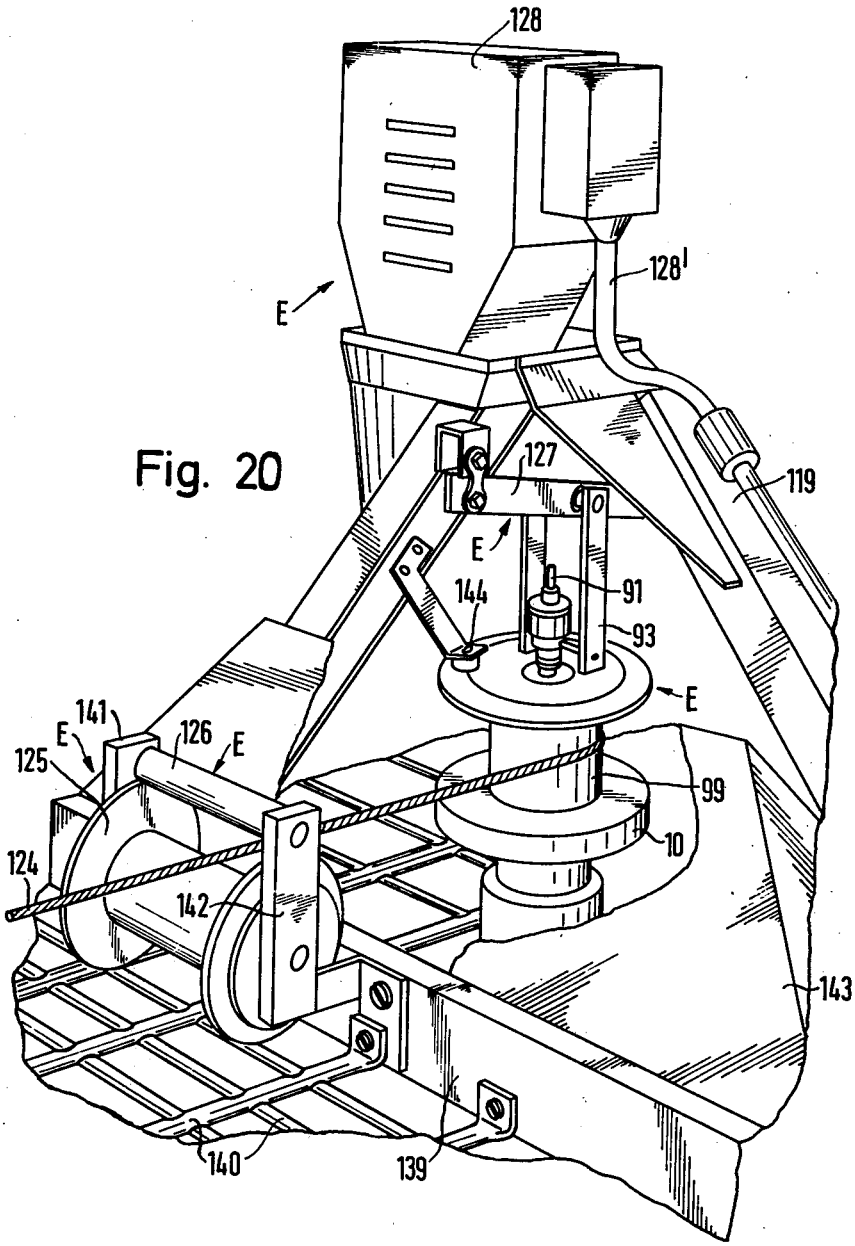
FIG. 20 is an enlarged axonometric view of part of the apparatus shown in FIG. 19.

Reference will now be made to FIG. 13 which shows the drum B on its undercarriage together with motor 3 and a shield 161 enclosing the belt drive 4, 4', 4'' of FIGS. 8 and 9. The top of drum B supports a superstructure including a yoke 119 of inverted V-shape and a loading platform 120 designed to receive the material to be mixed, such as sand, via a preferably wooden plank 121 with the aid of a shovel 122. The front end of the shovel is attached, via a chain 123, to the cable 124 (see FIGS. 1 and 20) adapted to be wound upon the reel 99, the cable 124 being guided by two rollers 125 and 126 as shown in FIG. 20. An electromagnet 128, supported by yoke 119, acts through an operating lever 127 upon the draw levers 92 to actuate the clutch 10 of shaft assembly C which in this instance again has the same position as in FIG. 1, being thus inverted with reference to FIGS. 7 and 11. Electromagnet 128 is energizable via a cable 128', branched off a 3-phase power supply at a junction box 130, under the control of a manual switch 133 which is carried on the handle 134 of shovel 122 and is connected to box 130 via a two-wire cable 131 looped around a pulley block 132. The monophase current passing through cable 131 may be derived from a transformer stepping down a supply voltage of 220V to 24V. A switch 129, shown in FIG. 15, controls the energization of drive motor 3.

Pulley block 132 is suspended from an arm 135 of a pole 136 which is articulated to the drum B by a swivel mounting 137 and is retained in its upright position by a clamp 138.

Figure 15:
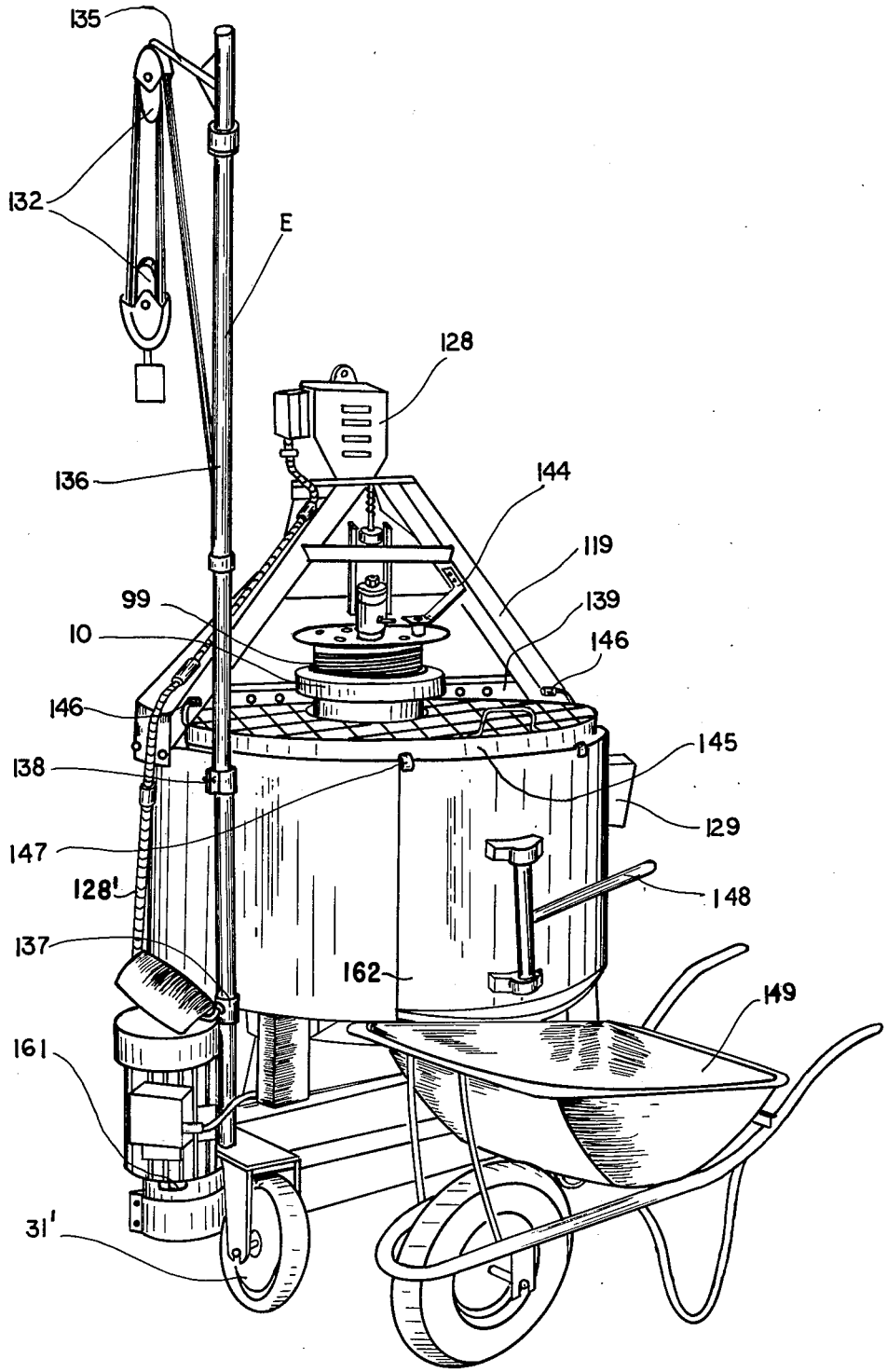
FIG. 15 is an axonometric view similar to FIG. 13, illustrating additional equipment associated with the apparatus.

A cross-beam 139, shown in FIGS. 15 and 20, spans the top of the drum and supports a safety net 140 as well as the aforementioned guide rollers 125 and 126 forming part of shovel drive E, these rollers being journaled in brackets 141 and 142 secured to beam 139. Also mounted on that beam is a shield 143 rising above platform 120. Wind-up reel 99 is subjected to a slight braking action by a resilient member 144. Net 140 has a rim 145 which is connected with the drum by two hinges 146 and has lugs 147 allowing it to be lifted, returning to its illustrated position under its own weight. A door 162 controlled by a handle 148 permits the contents of drum B to be discharged, e.g. into the unloader 157 of FIGS. 4 and 19 or into a wheelbarrow 149 shown in FIG. 15.

Figure 14:
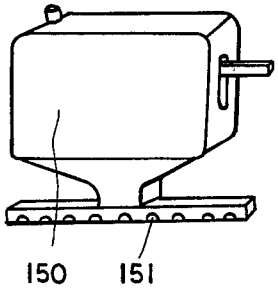
FIG. 14 is an axonometric view of a dosing device included in the apparatus of FIG. 13.
Figure 18:
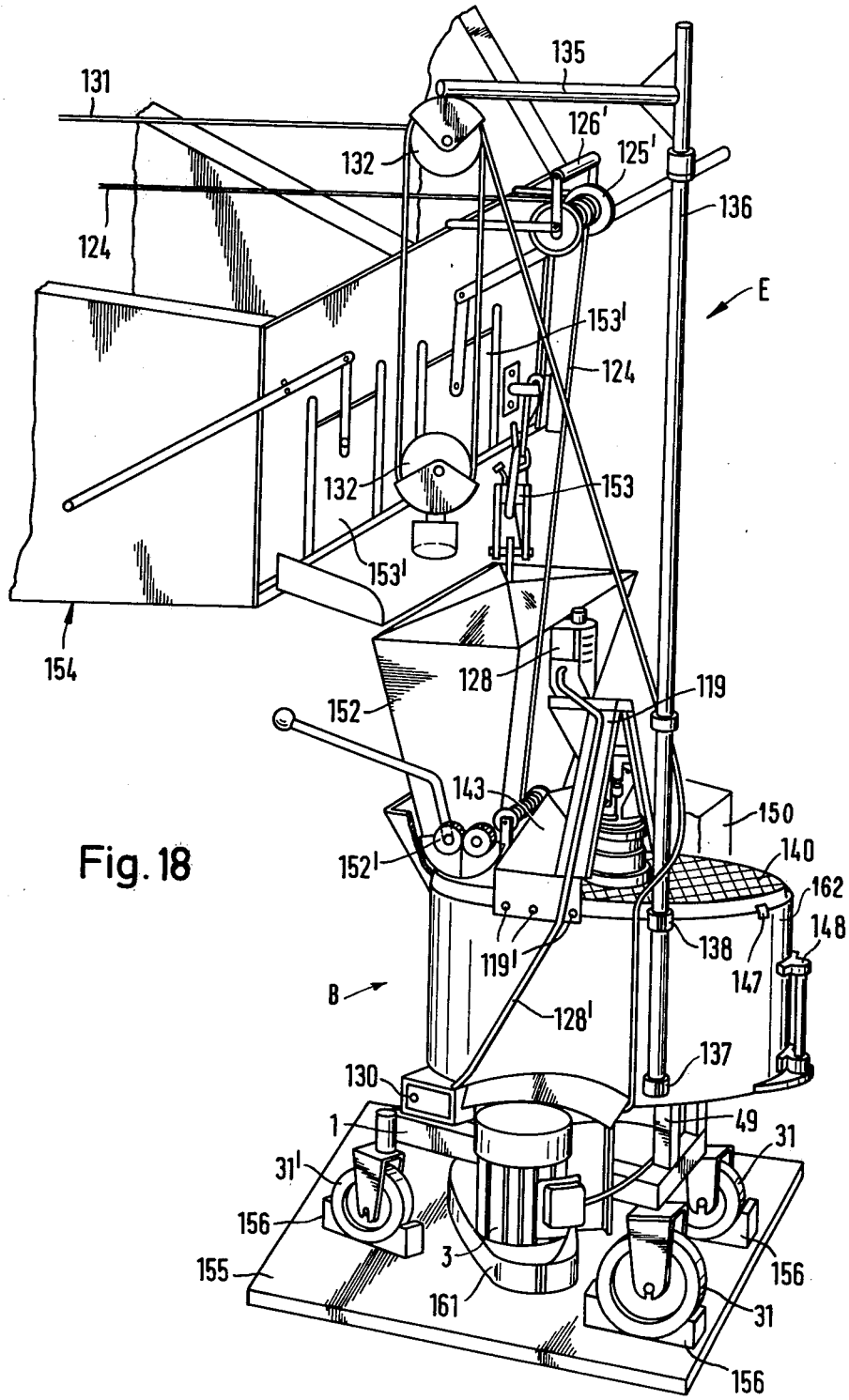
FIG. 18 is an axonometric view of yet another apparatus including a mixer according to our invention.

FIGS. 14 and 18 show a dosing device 150 having nozzle orifices 151 which increase from the middle outwardly and serve for the controlled admission of water and binders into the drum to form cement with sand delivered by shovel 122. The amount of sand loaded into the drum may be determined with the aid of a hydraulic balance comprising a bucket 152 which is suspended from a hydraulic cylinder 153 and receives the sand by way of a chute 154 having gates 153' as shown in FIG. 18; the cable 124 of shovel drive E is here shown guided by rollers 125', 126' supported on an end wall of the trough. An outlet 152' of bucket 152 allows its contents, after weighing, to be emptied into the drum B. FIG. 18 also shows the drum with its undercarriage resting on a platform 155 on which the wheels 31, 31' are immobilized by means of blocks 156; platform 155 may form part of another weighing device.

As shown in FIG. 19, plank 121 may form part of a gangway 159 along which the shovel 12 moves toward loading platform 120. This Figure also shows the aforedescribed unloader 157 positioned directly below the door 162.

Figure 21:
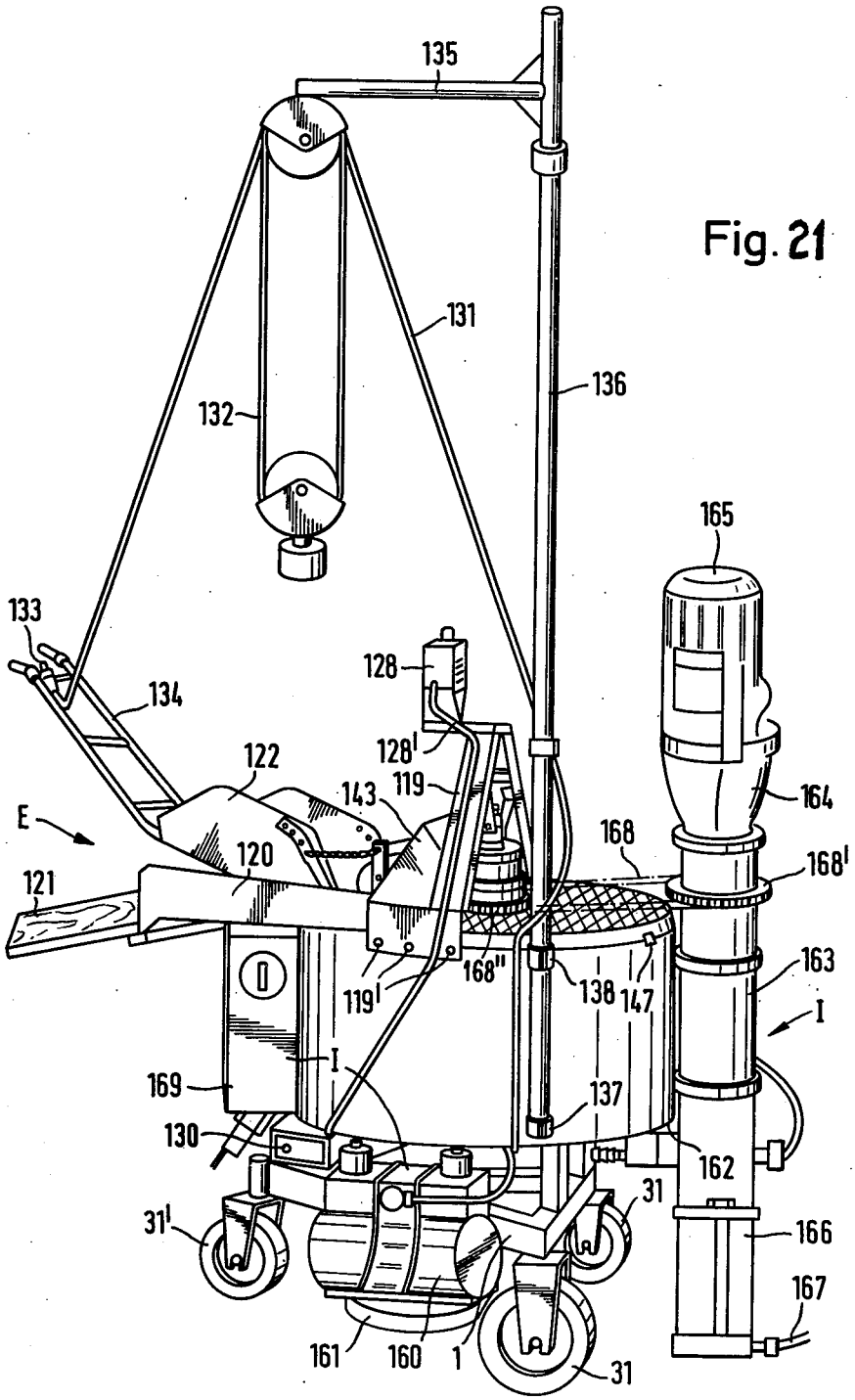
FIG. 21 is still another view similar to FIGS. 18 and 19, illustrating additional accessories.

As shown in FIG. 21, the undercarriage of the drum may support a compressor 160 resting on the shield 161, this compressor coacting with the plastering machine I here seen to be juxtaposed with the door 162 of the drum. Machine I comprises a screw conveyor 163 conventionally driven by a motor 165 via reducing gearing 164; a pump 166 is connected to a branch line 167. In the apparatus of FIG. 21 the screw conveyor 163 is driven by a sprocket 168' which is linked by a chain 168 with the sprocket 168" secured to reel 99, as shown in FIG. 11, thus obviating the need for using the motor 165 and the speed reducer 164. The electrical and pneumatic connections are contained in a box 169.

Figure 16:
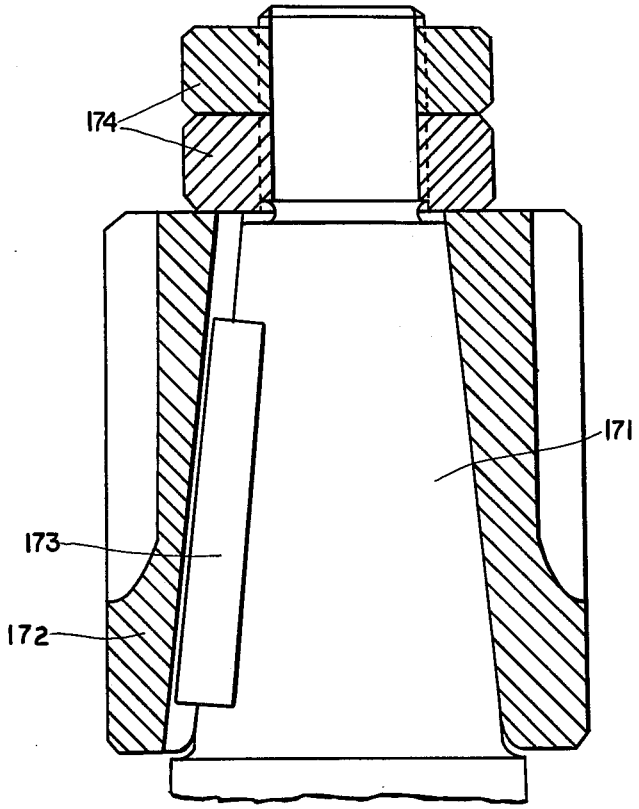
FIG. 16 is an enlarged axial sectional view of part of a gear transmission for a motorized shovel associated with a mixer according to our invention.
Figure 17:
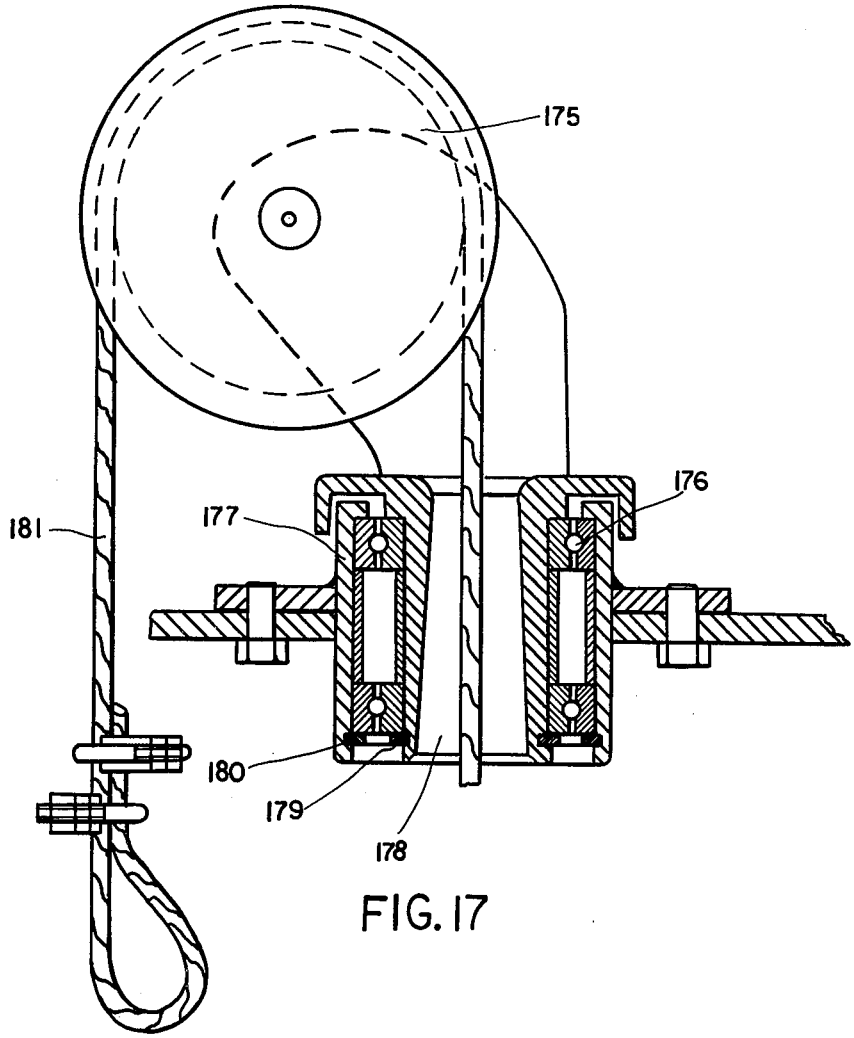
FIG. 17 is an enlarged elevational view, partly in section, of a cable guide for the aforementioned motorized shovel.
Figure 31:
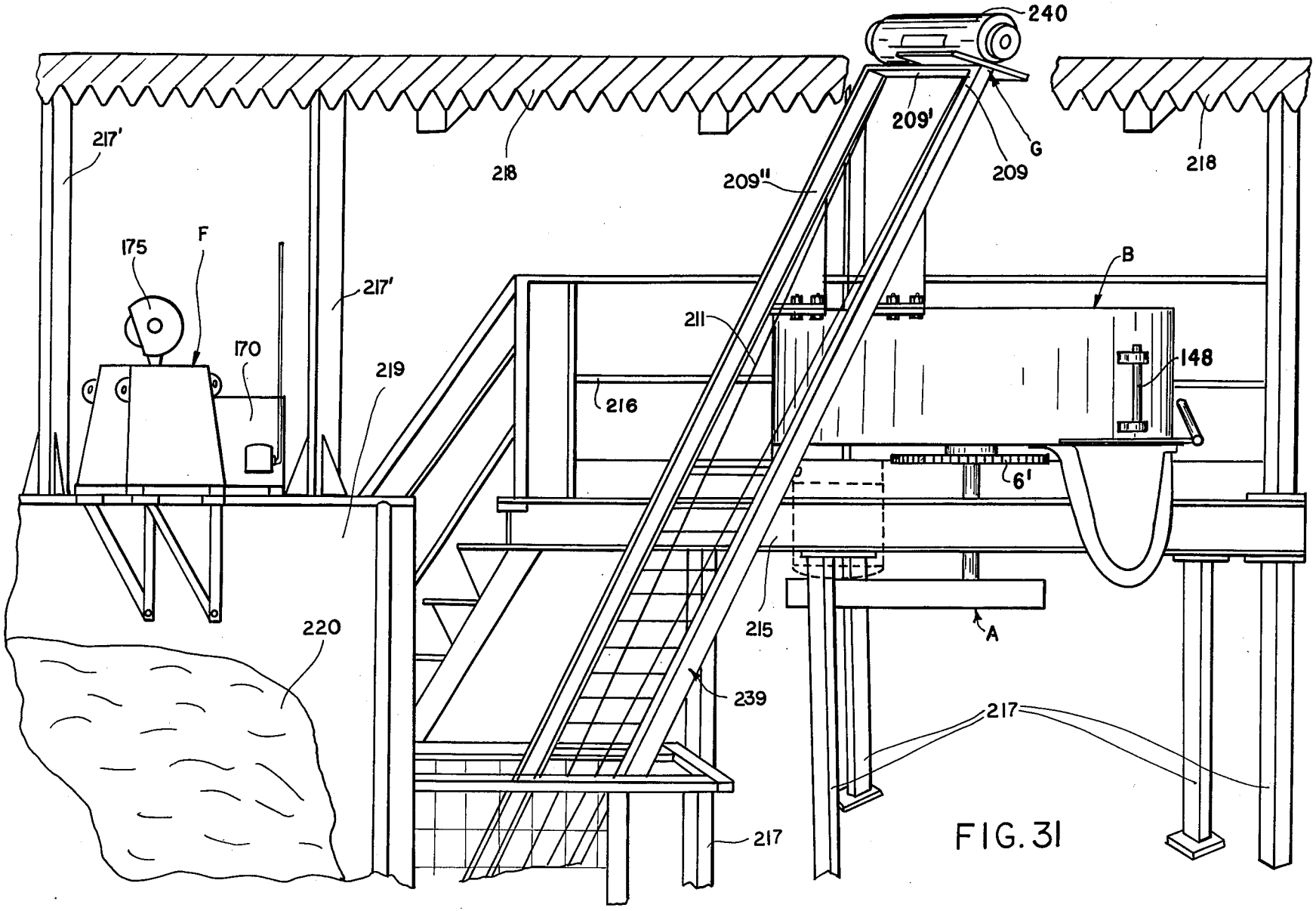
FIG. 31 is an enlarged axonometric view of part of an apparatus similar to that shown in FIG. 30.

In FIGS. 30 and 31 we have shown separate loading equipment F comprising a mechanical shovel 170 with a motor whose shaft has a frustoconical extremity 171, FIG. 16, to which a pinion 172 is secured by nuts 174 while being held against rotation by a key 173. The shovel also has a swivelable guide roller 175 for a cable 181, similar to the roller 301' of FIG. 3, shown in greater detail in FIG. 17. Roller 175 is supported by a hollow mounting 178 which is journaled in a casing 177 by ball bearings 176 and is held in position by circlips 179 and 180, the cable 181 passing through the reel mounting 178.

Figure 23:
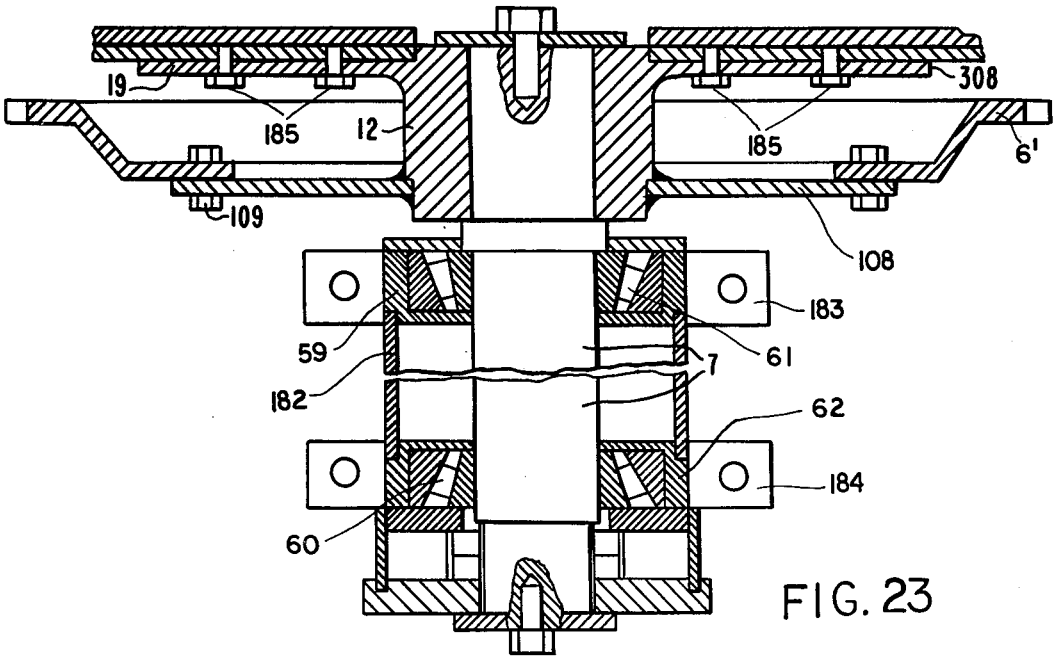
FIG. 23 is an enlarged axial sectional view of a shaft coupling for a mixer drum.
Figure 22:
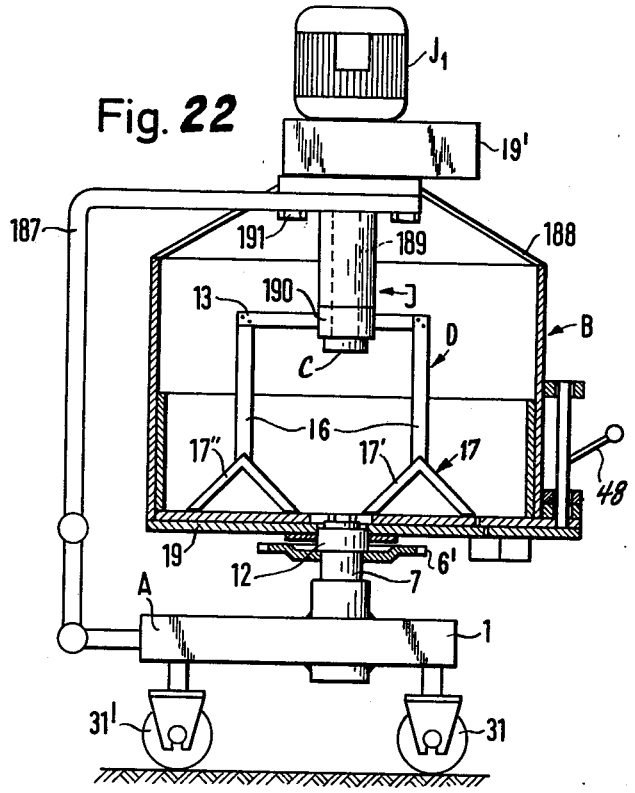
FIG. 22 is an elevational view, partly in section, of a modified mixer provided with a separate agitator drive.

In FIGS. 22 and 23 we have shown modified mixers in which the main shaft 7, driven from motor 3 (FIG. 1) via the aforedescribed belt and chain transmissions including sprocket 6', terminates at the bottom of body 19 of drum B.

Figure 24:
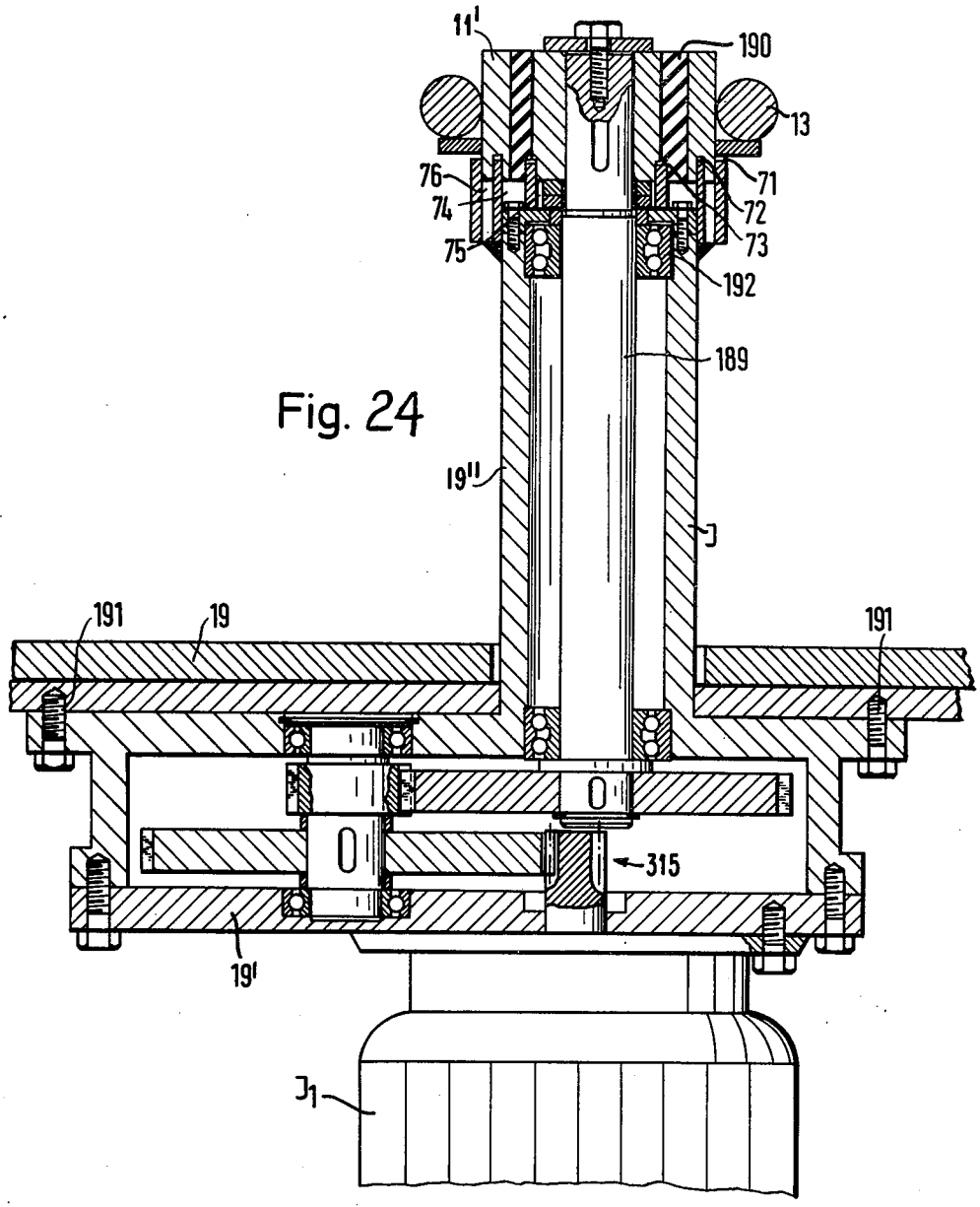
FIG. 24 is a view generally similar to FIG. 23 but showing details of an agitator drive illustrated in FIG. 22.

As illustrated in FIG. 23, the drum body 19 is connected by screws 185 with a flange 308 of hub 12 whose flange 108 is fastened to sprocket 6' by bolts 109, as in FIG. 11. Shaft 7, rigid with hub 12, is journaled in the rings 59, 62 by bearings 60 and 61, the two rings being again interconnected (as in FIG. 11) by a sleeve 182 and being provided with respective lugs 183 and 184 facilitating their attachment to the triangular base 1 of framework A. In this case, therefore, the drum (which could also be directly welded to the shaft) is rotatably entrained by sprocket 6'. In FIG. 22, on the other hand, a separate drive J is provided for the agitator D including spider arms 13 with depending legs 16 and supporting blades 17, the drive J comprising a motor $J_1$ with a shaft 189 supported on framework A by an arm 187 and a casing 19' which is linked by stays 188 with the nonrotating drum B. The assembly J has been illustrated in greater detail, albeit in inverted position, in FIG. 24 where motor $J_1$ is disposed below the bottom of drum body 19 to which the casing 19' is secured by screws 191, this casing containing a speed reducer 315 connecting the motor with shaft 189. In the arrangement of FIG. 24, spider arms 13 of agitator assembly D are mounted on a hub 11' which is coupled with shaft 189 through the intermediary of an elastic sleeve 190; shaft 189 is journaled by bearings 192 to a tubular extension 19" of casing 19'which forms with hub 11' a plurality of annular grease compartments 74–76 defined by a sleeve 71 and labyrinth-type lips 72, 73 substantially as shown in FIG. 11.

Figure 25:
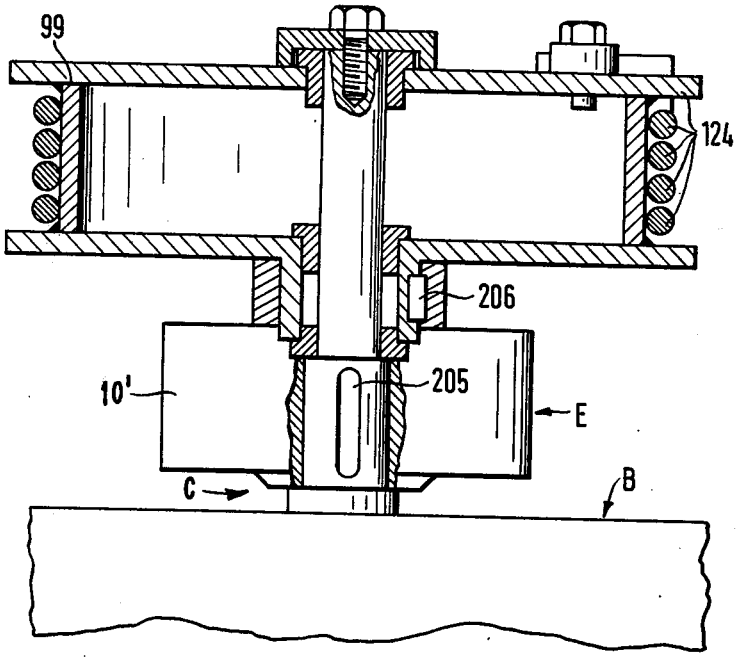
FIG. 25 is another enlarged detail view, generally similar to FIGS. 23 and 24, showing a wind-up reel together with an associated clutch.

In FIG. 25 we have shown the shovel drive E disposed above the drum B, this drive comprising an electromagnetic clutch 10' with an outer part keyed at 205 to the main shaft assembly C and with an inner part coupled by a key 206 to the hub of reel 99 engaged by cable 124.

Figure 29:
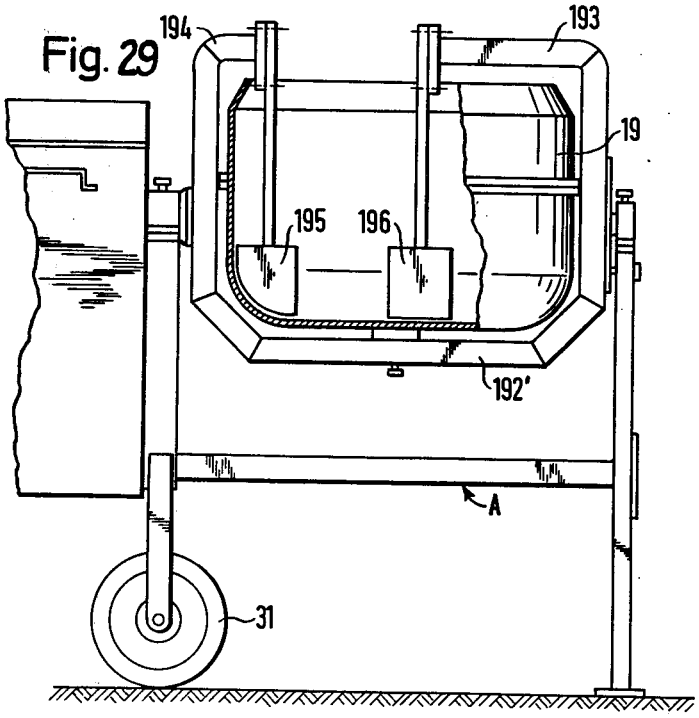
FIG. 29 is a view similar to FIG. 22, showing a rotatable mixer drum with stationary agitator blades.

According to FIG. 29, framework A has an extension 192' in which the drum body 19 is rotatably supported, arms 193 and 194 of that extension carrying stationary stirring blades 195 and 196 which are preferably made of rubber.

In FIGS. 30 and 31 we further show a guide track 239 for a bucket 210 extending from the bottom of a pit 207 to a location above the drum B which in this instance is again fixedly supported by columns 32. Track 239, which forms part of the hoist drive G, comprises two parallel bars 209, 209" interconnected at the top by a cross-bar 209' which carries a deflecting roller 212 for a cable 211 anchored to that cross-bar, the cable being also wound around a pulley 214 on bucket 210 as well as around a guide roller 213 on the rim of the drum body 19. Reel 77 of shaft assembly C, bracketed by clutches 8 and 9, serves to wind up the cable 211 in order to raise the bucket 210 along its track 239. Also shown in FIG. 30 is a guide track 208 for the motorized shovel 170.

FIG. 31 illustrates a more elaborate supporting framework A comprising a platform with girders 215 and a railing 216, overlain by a roof 218 supported by posts 217 and 217'. A pile of sand 220 lies behind a wall 219 supporting the motorized shovel 170. The cable 211 is here conventionally controlled by an electric motor 240.

Figure 32:
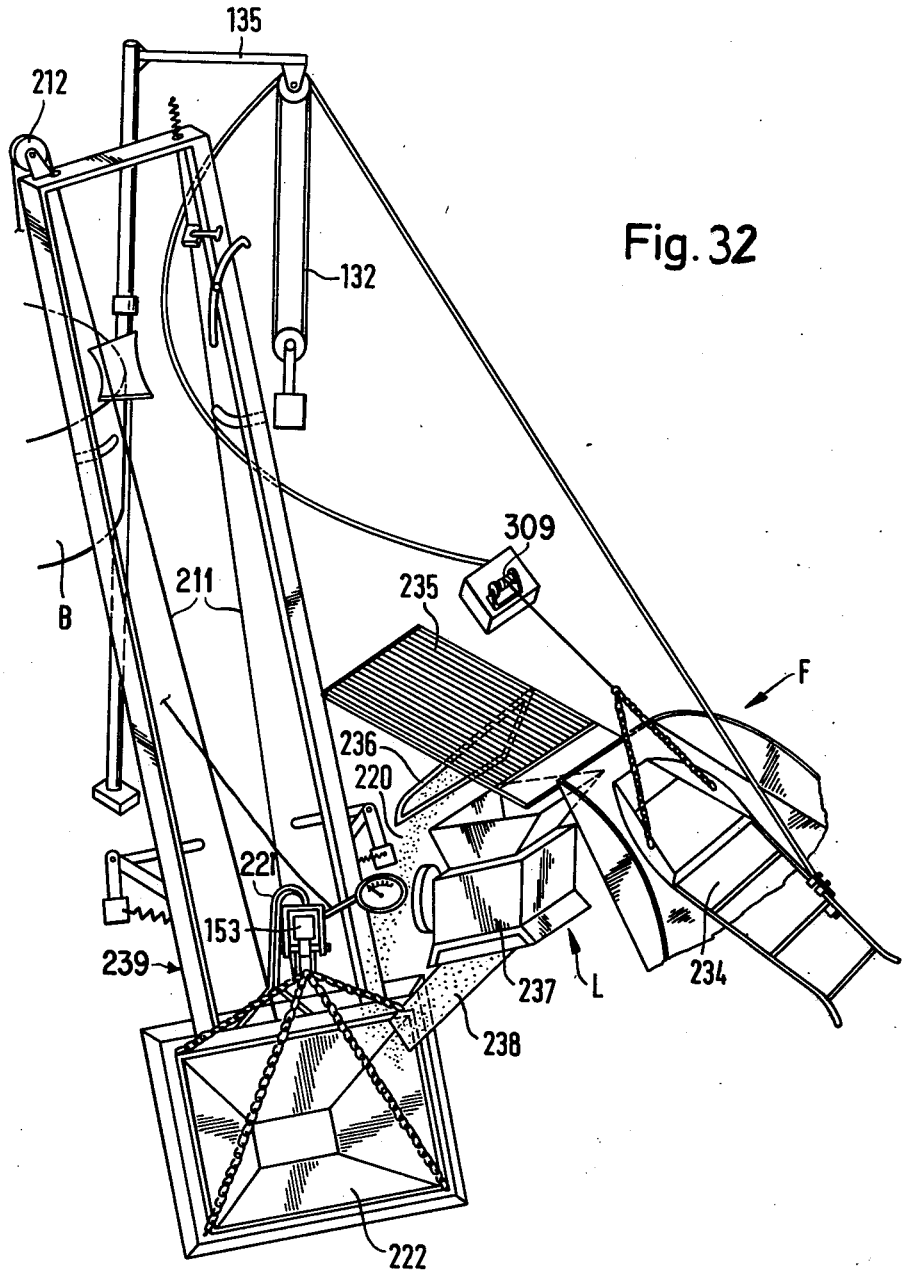
FIG. 32 is an axonometric view of additional equipment for the apparatus of FIG. 30.

FIG. 32 shows part of the drum B together with guide track 239 and another separate loader F comprising a shovel 234 which is generally similar to the shovel 122 of FIGS. 13 and 19 but is entrainable by a wind-up reel 309 remote from the drum shaft. The sand 220 to be loaded into the drum is brought on by the shovel 234 and dumped through a screen 235, provided with a stand 236, into a crusher 237 delivering the fragmented material via a chute 238 to a bucket 222 adapted to be hoisted on guide track 239 substantially in the manner described above for the bucket 210. Screen 235 and crusher 237 together constitute comminuting equipment L.

Figures 33, 34:
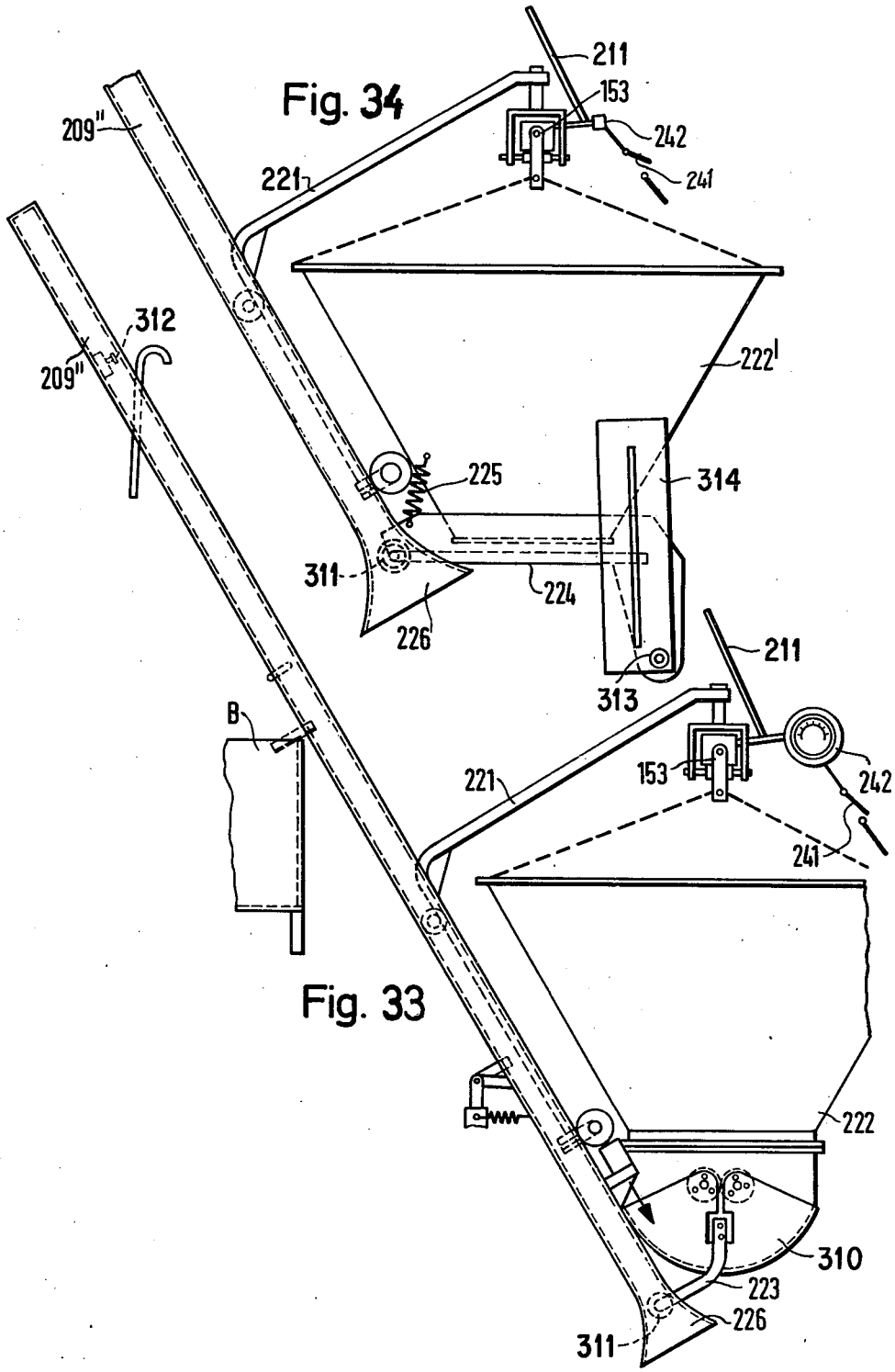
FIG. 33 is a fragmentary side-elevational view of a guide for a bucket used with the equipment of FIG. 30.
FIG. 34 is a view similar to FIG. 33, showing a modified bucket.

Bucket 222 is suspended, via a hydraulic cylinder 153 similar to that shown in FIG. 18, on a carriage 221 entrained along track 239 by the cable 211 as more clearly illustrated in FIG. 33. The latter Figure also shows a handle 223 which controls a bottom gate 310 of bucket 222 and carries a roller 311 entering the flared bottom end 226 of the hollow track member 209" at the start of the upward movement so as to prevent untimely opening of that gate. A manometric device 242 responsive to the pressure inside cylinder 153 closes a switch 241 to actuate the hoist when the bucket has been sufficiently filled; a limit switch 312 is tripped upon the arrival of carriage 221 in its terminal position to arrest the drive, allowing the bucket to be emptied.

FIG. 34 shows a hoisting assembly similar to that of FIG. 33 with a modified bucket 222' whose bottom gate is formed by a flap 224 biased by springs 225 into its illustrated closure position, the flap 224 being pivoted at 313 to an extension 314 of the bucket and being provided with the aforementioned roller 311 designed to prevent untimely opening.

Figure 35:
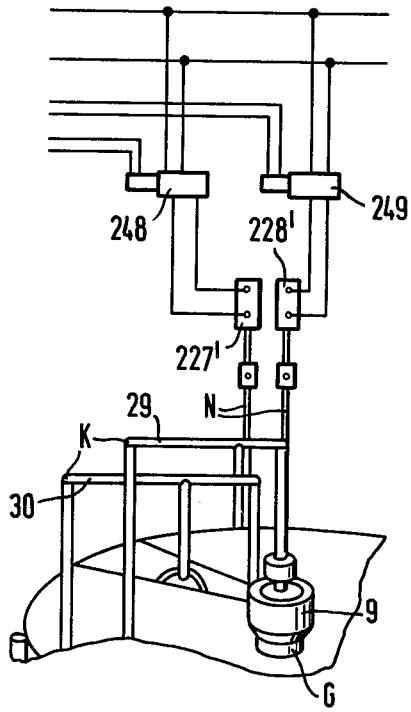
FIG. 35 is a partly schematic view of an electromagnetic/hydraulic control system for a mixer according to our invention.
Figure 36:
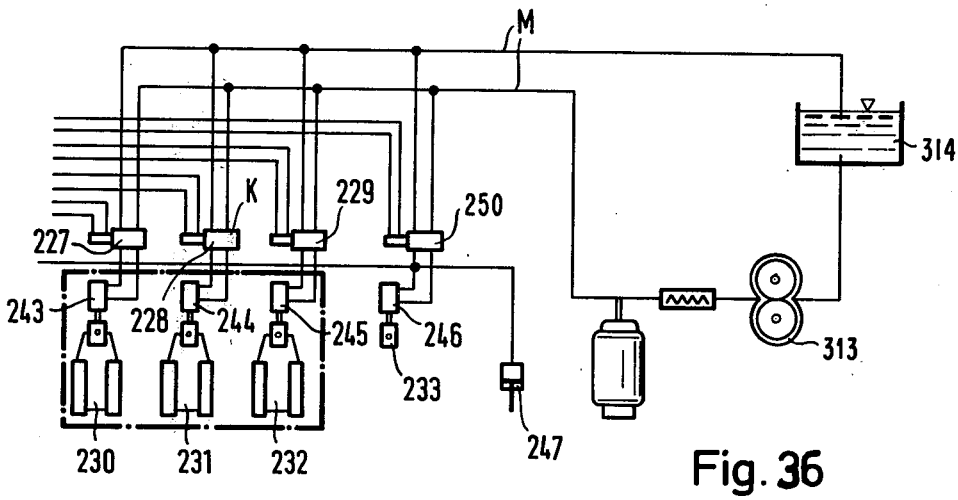
FIG. 36 diagrammatically shows other parts of such a control system.

The actuating mechanism K for the clutch and brake devices 8-10 can be controlled electromechanically by a system N shown in FIG. 3 or electro-hydraulically by a system M shown in FIG. 36. In FIG. 35 the mechanism K includes the handles 29 and 30 of FIGS. 1, 7 and 30 along with switches 248, 249 which are electrically operated from a nonillustrated control panel for selectively energizing respective electromagnets 227' and 228'. In FIG. 36 we have shown a number of electromagnetically controlled valves 227, 228, 229, 250 for the selective admission of fluid to hydraulic cylinders 243–247, cylinders 243–246 controlling respective working cylinders 230–233. The hydraulic fluid is delivered by a pump 313 from a reservoir 314.

We claim:

1. An apparatus for mixing bulk material, comprising: a framework including a generally triangular base;

an upwardly open mixing drum supported on said base and centered on a substantially vertical axis;

agitator means in said drum;

mechanism for relatively rotating said agitator means and said drum, said mechanism including main shaft means centered on said axis and provided with ancillary force-transmitting means forming part of a power train selectively actuatable for the operation of associated material-handling equipment; and drive means for rotating said main shaft means to impart relative rotation to said drum and said agitator means, said drive means including a motor secured to said framework on one side of said base, an auxiliary shaft journaled on another side of said base, a first step-down transmission linking said motor with said auxiliary shaft, and a second step-down transmission linking said auxiliary shaft with said main shaft means.

2. An apparatus as defined in claim 1 wherein said first transmission comprises a belt drive and said second transmission comprises a chain drive.

3. An apparatus as defined in claim 1 wherein said drum is stationary on said base, said main shaft means extending into said drum and supporting said agitator means.

4. An apparatus as defined in claim 3 wherein said main shaft means forms a hub above the bottom of said drum provided with an array of spider arms tangentially secured to said hub, said agitator means being coupled to said arms through elastic joints.

5. An apparatus as defined in claim 4 wherein said agitator means comprises a set of inclined blades near said bottom and a wiper at an elevated level adjacent the inner periphery of said drum.

6. An apparatus as defined in claim 1 wherein said main shaft means comprises a lower shaft portion underneath said drum and an upper shaft portion above said drum, said second transmission extending below said drum to said lower shaft portion, said agitator means being secured to said upper shaft portion.

7. An apparatus as defined in claim 6 wherein said drive means further comprises an additional motor for driving said upper shaft portion.

8. An apparatus as defined in claim 6 wherein said upper shaft portion is an extension of said lower shaft portion, said ancillary force-transmitting means comprising a wind-up reel on said upper shaft portion and a clutch actuatable for the rotary entrainment of said reel.

9. An apparatus as defined in claim 8 wherein said drum is provided with a superstructure overhanging said upper shaft portion and carrying operating means for actuating said clutch.

10. An apparatus as defined in claim 9 wherein said operating means comprises an electromagnet.

11. An apparatus as defined in claim 9 wherein said superstructure forms a track for a transporter forming part of said associated equipment, said transporter being linked with a cable wound upon said reel.

12. An apparatus as defined in claim 11 wherein said transporter is a shovel carrying a manually operable switch connected via a flexible conductor to said operating means.

13. An apparatus as defined in claim 11 wherein said transporter includes a bucket provided with a bottom gate and guided by said track along an inclined path.

14. An apparatus as defined in claim 13 wherein said transporter further includes a carriage, said bucket being suspended from said carriage through the intermediary of a hydraulic cylinder.

15. An apparatus as defined in claim 8 wherein said upper shaft portion carries a sprocket wheel linked via a chain drive with a screw conveyor forming part of said associated equipment.

16. An apparatus as defined in claim 8 wherein said ancillary force-transmitting means further comprises a brake on said upper shaft portion, said reel being interposed between said clutch and said brake.

17. An apparatus as defined in claim 6 wherein said ancillary force-transmitting means comprises a sprocket wheel on said lower shaft portion and a clutch actuatable for the rotary entrainment of said sprocket wheel.

18. An apparatus as defined in claim 1 wherein said base is provided with three supporting members at respective vertices of the triangle.

19. An apparatus as defined in claim 18 wherein said supporting members are wheels.

* * * * *